US006868704B2

(12) United States Patent
Simon et al.

(10) Patent No.: US 6,868,704 B2
(45) Date of Patent: Mar. 22, 2005

(54) ANTI-VANDAL DOOR LOCK APPARATUS

(75) Inventors: Ira J. Simon, Long Beach, CA (US); Martin S. Simon, Long Beach, CA (US)

(73) Assignee: Triangle Brass Manufacturing Company, Inc., Los Angeles, CA (US)

( * ) Notice: Subject to any disclaimer, the term of this patent is extended or adjusted under 35 U.S.C. 154(b) by 182 days.

(21) Appl. No.: 09/917,019

(22) Filed: Jul. 25, 2001

(65) Prior Publication Data

US 2003/0019257 A1 Jan. 30, 2003

(51) Int. Cl.[7] ..... E05B 9/08; E05B 13/10

(52) U.S. Cl. ..... 70/215; 70/224; 70/370; 70/432; 70/452; 70/DIG. 6; 70/DIG. 59; 70/DIG. 60

(58) Field of Search ..... 70/370, 371, DIG. 27, 70/DIG. 6, DIG. 60, 224, 452, 210, 215–217, 432, DIG. 59

(56) References Cited

U.S. PATENT DOCUMENTS

| | | | | | |
|---|---|---|---|---|---|
| 1,010,727 | A | * | 12/1911 | Corbin et al. | |
| 1,755,434 | A | * | 4/1930 | Ellingson | |
| 1,811,110 | A | * | 6/1931 | Best et al. | |
| 2,418,044 | A | * | 9/1947 | Nehls | |
| 2,489,072 | A | | 11/1949 | Ausubel | |
| 2,672,746 | A | * | 3/1954 | Arens | |
| 2,757,033 | A | * | 7/1956 | Noca | |
| 3,368,374 | A | * | 2/1968 | Eads | |
| 3,391,674 | A | | 7/1968 | Burleigh | 16/110 R |
| 3,645,045 | A | | 2/1972 | Gervis et al. | 70/452 X |
| 3,698,217 | A | | 10/1972 | Roy | 70/451 |
| 3,764,173 | A | | 10/1973 | Griffith | 292/346 |
| 3,888,530 | A | | 6/1975 | Fabrici | 282/340 |
| D242,597 | S | | 12/1976 | Gamus | D8/137 |
| 4,095,445 | A | * | 6/1978 | Storlie et al. | 70/215 |
| 4,195,502 | A | * | 4/1980 | Best et al. | 70/224 |
| 4,237,712 | A | * | 12/1980 | Cramer | 70/417 |
| D265,720 | S | | 8/1982 | Harrison | D8/346 |
| 4,424,691 | A | * | 1/1984 | Foshee | 70/224 |
| 4,428,212 | A | | 1/1984 | Best et al. | 70/224 |
| 4,484,463 | A | | 11/1984 | Hennessy | 70/452 |
| 4,489,576 | A | * | 12/1984 | Mullich et al. | 70/134 |
| 4,583,776 | A | | 4/1986 | Bouchard | 292/346 |

(List continued on next page.)

FOREIGN PATENT DOCUMENTS

| | | | | |
|---|---|---|---|---|
| FR | 921069 | | 4/1947 | 70/418 |
| FR | 1012717 | * | 7/1952 | 70/370 |
| GB | 618766 | * | 2/1949 | 70/370 |

OTHER PUBLICATIONS

Photograph of door pull manufactured by Triangle Brass Manufacturing Company, Inc., prior to Jan. 2000.

Catalog p. 2, Sargent Manufacturing Company, "Cylinders & Components, Bored Lock and Mail Box Cylinders" (Apr. 1992).

Catalog p. 4, Sargent Manufacturing Company, "Cylinders & Components, Mortise/Rim Cylinders" (Apr. 1992).

Instructions for installing Sargent 10–Line and FW–10 Line Locks, Sargent Manufacturing Company, (single 2–sided sheet copied as 4 sheets), prior to Jan. 2000.

*Primary Examiner*—Lloyd A. Gall
(74) *Attorney, Agent, or Firm*—David Weiss

(57) ABSTRACT

An anti-vandal door lock apparatus in which a cylinder lock such as a mortise lock cylinder is employed for unlatching a cylindrical lock assembly. In a preferred embodiment, the mortise lock cylinder is mounted to the outside of a door trim such as a pull plate, with the cylindrical lock mounted to the inside of the trim, and the pull plate is mounted to the door, in such manner as to effect an anti-vandal door lock assembly. Preferred embodiments may include a hold-back feature, as well as a feature for facilitating secured removal of the mortise lock cylinder as for re-keying.

24 Claims, 6 Drawing Sheets

U.S. PATENT DOCUMENTS

| | | | | | |
|---|---|---|---|---|---|
| 4,751,834 | A | | 6/1988 | Beck | 70/452 |
| 4,802,701 | A | | 2/1989 | Mazie | 292/340 |
| 4,841,754 | A | | 6/1989 | Jones | 70/207 |
| 4,869,083 | A | | 9/1989 | DeMarseilles et al. | 70/224 |
| 5,131,189 | A | | 7/1992 | Mascotte | 70/417 X |
| 5,272,895 | A | | 12/1993 | Best | 70/369 |
| 5,291,767 | A | | 3/1994 | Weindorf, Jr. et al. | 70/370 |
| D353,319 | S | | 12/1994 | Eckert | D8/346 |
| D354,670 | S | | 1/1995 | Simon et al. | D8/353 |
| 5,457,975 | A | * | 10/1995 | Berger et al. | 70/370 |
| 5,475,998 | A | | 12/1995 | Raskevicius et al. | 70/495 |
| 5,586,459 | A | * | 12/1996 | Bullock et al. | 70/224 |
| 5,678,870 | A | | 10/1997 | Pelletier | 292/244 |
| 5,730,478 | A | | 3/1998 | D'Hooge | 292/348 |
| 5,794,472 | A | * | 8/1998 | Kester et al. | 70/472 |
| 5,865,050 | A | * | 2/1999 | Michaud et al. | 70/416 |
| 5,901,590 | A | * | 5/1999 | Lai | 70/416 |
| 5,970,760 | A | * | 10/1999 | Shen | 70/371 |
| 5,992,195 | A | | 11/1999 | Huang et al. | 70/472 |
| D417,833 | S | | 12/1999 | Heithe | D8/346 |
| 6,145,358 | A | * | 11/2000 | Wu | 70/467 |
| 6,178,794 | B1 | | 1/2001 | Eller et al. | 70/472 |

* cited by examiner

Fig. 3.
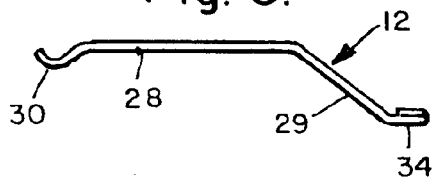
Fig. 2.
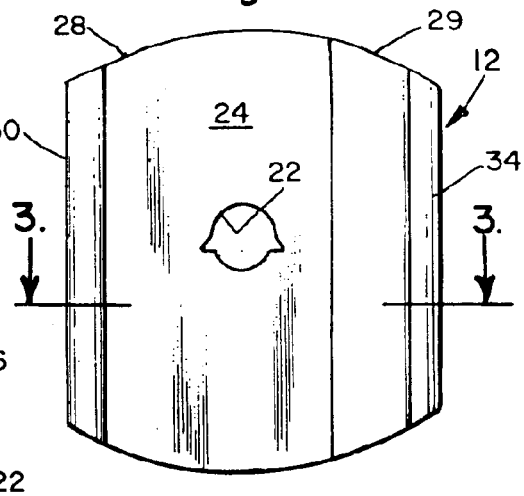
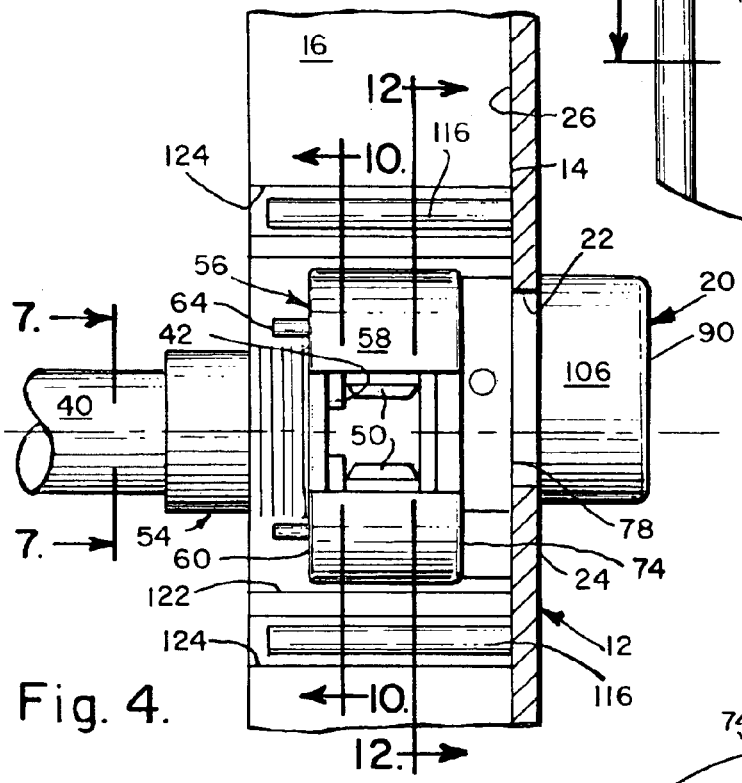
Fig. 4.
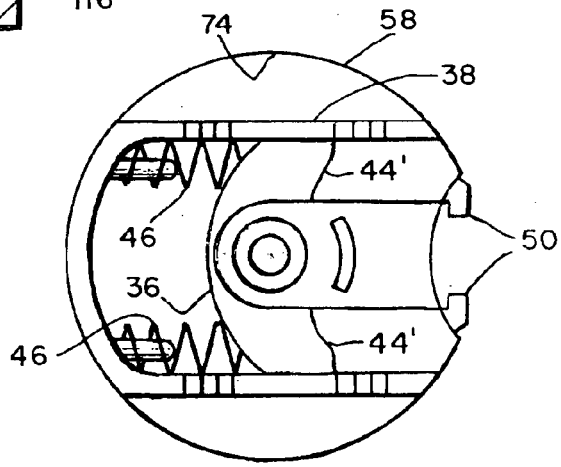
Fig. 6.

Fig. 9.
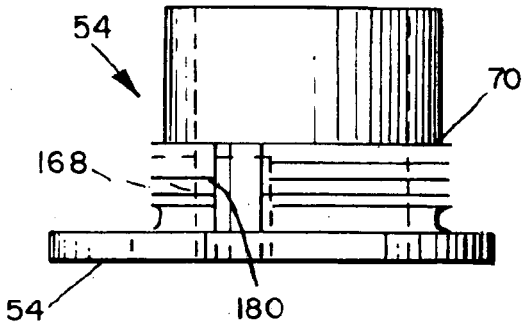
Fig. 10a.
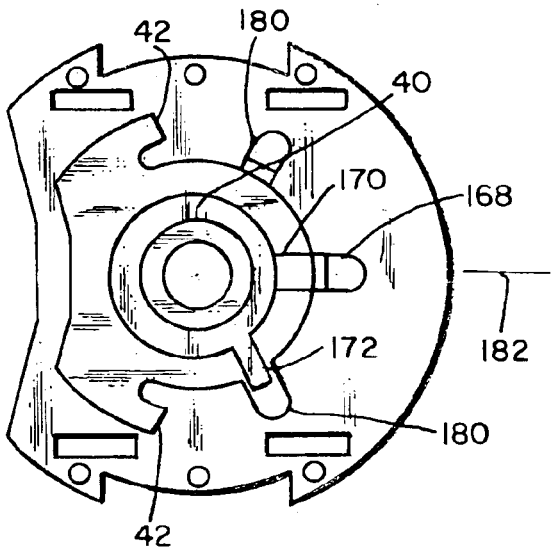
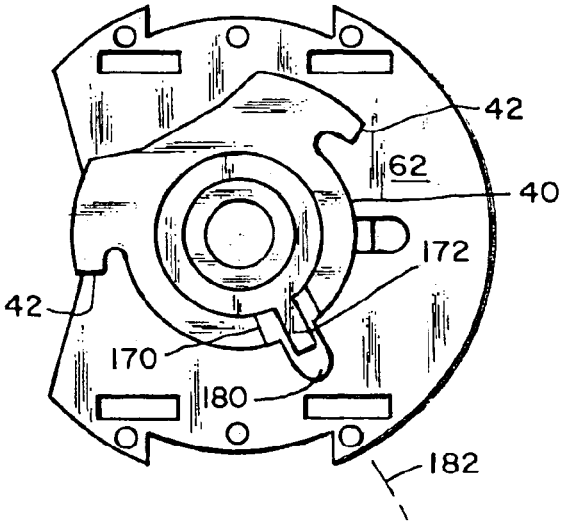
Fig.10b.
Fig. 11.
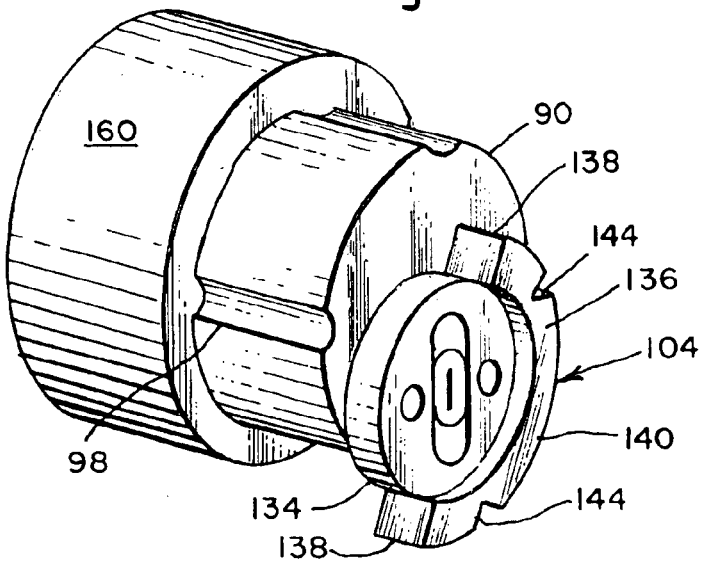

ANTI-VANDAL DOOR LOCK APPARATUS

BACKGROUND OF THE INVENTION

This invention relates to cylindrical locks for doors, and more particularly to a vandal-resistant cylindrical lock apparatus useful in commercial and other public applications.

A cylindrical lock for a door conventionally includes a spring-loaded retractor for retracting and releasing a latchbolt for unlatching and latching the door. The lock body is mounted in a large bore through the door while the latchbolt is housed in an intersecting smaller diameter bore through the edge of the door. The retractor is operated by rotating either one of an inside handle and an outside handle, with the outside handle generally equipped with a key-actuable lock for preventing rotation of the outside handle. Although cylindrical locks are considered to be economical in terms of their manufacture and installation, they are vulnerable to damage by vandals and burglars such as through destructive manipulation of the cylindrical lock's outside handle. The situation is exacerbated for cylindrical locks fitted with lever handles, as may be required for installation on exterior doors in schools and other public buildings in accordance with applicable regulations, since lever handles exert greater torque on the cylindrical lock assembly than do knob handles.

A more secure type of lock apparatus for a door, although more expensive in terms of both manufacture and installation than a cylindrical lock apparatus, is a mortise lock apparatus in which the latching and locking mechanisms are contained in a rectangular case mounted in a rectangular cavity in the edge of the door. A conventional mortise lock assembly is equipped with a lock cylinder, key-actuable from the outside, which enters the lock case independent of the outside handle. When the key is inserted in the mortise lock cylinder and rotated, a correspondingly rotated cam pivots an included tail piece which trips the locking mechanism within the lock case. In some mortise locks, further rotation of the key causes correspondingly further pivoting of the tail piece for tripping the mechanism for unlatching the door. Since only the face of the mortise lock cylinder is exposed outside the door, the lock cylinder is extremely difficult to grab or remove. Further, since the mortise lock mechanism having a locking and unlocking function typically operates independently of the handles, defeating or destroying the outside handle of an installed mortise lock—unlike a conventional cylindrical lock—gets a vandal no closer to gaining unauthorized access.

In view of this background, there has existed a need for a door lock having the economy of manufacture and installation of a cylindrical lock but with the security advantages of a mortise lock.

SUMMARY OF THE INVENTION

The present invention incorporates a cylinder lock device into a cylindrical lock apparatus, combining the security features of a mortise lock cylinder with the manufacturing and installation economies of a cylindrical lock. The cylinder lock device, which is preferably a mortise lock cylinder, is secured to the outside of the door or preferably to the outside of a door trim such as a plate secured to the outside face of the door, with the cylindrical lock mounted to the inside of the plate. A cam secured to and rotatable with the key-actuable mortise cylinder engages the retractor mechanism of the installed cylindrical lock assembly of the present invention for unlatching the latchbolt. The assembly is not fitted with an outside handle for unlatching the latchbolt, and the inside handle preferably includes a key-actuable hold-back feature, employing a lever handle the rotated position of which is indicative as to whether the hold-back feature has been engaged. Another preferred feature facilitates secured removal of the cylinder lock device from the cylindrical lock assembly, such as for re-keying.

A preferred embodiment of an anti-vandal door lock apparatus in accordance with the present invention comprises the combination of: a cylindrical lock assembly including a latchbolt, a lock body having a retractor for the latchbolt, a spindle extending from a first side of the lock body and coupled to the retractor for unlatching the latchbolt upon rotation of the spindle, and a handle secured to the spindle for rotating the spindle; a cylinder lock (preferably a mortise lock cylinder) including a housing and a cylinder actuable for rotation in the housing, the cylinder lock extending from a second side of the lock body opposite the first side; and a cam secured to the cylinder and rotatable therewith, the cam coupled to the retractor for unlatching the latchbolt upon rotation of the cylinder. The cylinder lock is preferably key-actuable for rotating the rotatable cylinder upon rotation of a provided key.

The preferred embodiment may further include a door trim securable to a face of the door, and the lock body is preferably secured to the door trim with the cylinder lock rotatably actuable from one side of the door trim and the handle of the cylindrical lock assembly is rotatable from another side of the door trim opposite the first side. The door trim is preferably a pull plate, including a door-engaging section securable to the door, a pull handle extending from the door-engaging section, and a top edge and a bottom edge tapering toward the pull handle from the door-engaging section.

According to an aspect of a preferred embodiment of the present invention, a hold-back device is provided in the cylindrical lock assembly, including a lock in the handle for locking the spindle when the spindle is in a rotated position unlatching the latchbolt. The handle is preferably a lever handle and is in a rotated position when the spindle is locked in the hold-back position.

The hold-back device is preferably provided by a radial first notch included in a chassis plate of the lock body, the chassis plate rotationally supporting the spindle which includes a second notch in radial alignment with the first notch when the spindle is in a rotated position unlatching the latchbolt; a radially extending member, such as a tab, carried by the spindle and captured by the first notch; and a lock in the handle coupled to the tab for moving the tab longitudinally along the notches, when the notches are radially aligned, between a first longitudinal position captured by the second notch and a second longitudinal position not captured by the second notch. The lock may be a bored cylinder lock having a rotatable tail piece, and the hold-back apparatus may include a rotational-to-translational motion converter carried by the spindle for converting rotation of the tail piece to longitudinal movement of the tab. The bored lock cylinder is preferably key-actuated, in which case a key is provided which is insertable in the bored lock cylinder and rotatable for rotating the tail piece.

According to another aspect of the preferred embodiment of the present invention, the door trim includes an opening, and the apparatus further includes an attachment plate secured to the door trim, the attachment plate including an opening in registration with the opening in the door trim, the openings permitting insertion of the cylinder lock therein, the attachment plate adapted to releasably secure the cylinder lock thereto when the cylinder lock is inserted in the openings. The opening in the attachment plate and the opening in the door trim are configured for facilitating outward withdrawal of the cylinder lock upon rotation of the cylinder with the key inserted therein.

BRIEF DESCRIPTION OF THE DRAWINGS

The novel features believed to be characteristic of the invention, together with further advantages thereof, will be better understood from the following description considered in connection with the accompanying drawings in which preferred embodiments of the present invention are illustrated by way of example. It is to be expressly understood, however, that the drawings are for the purpose of illustration and description only and are not intended as a definition of the limits of the invention.

FIG. 2 is a front elevation view of a preferred embodiment of one configuration of an anti-vandal pull plate included in the apparatus shown in FIG. 1;

FIG. 3 is a cross-sectional view of the pull plate of FIG. 2, taken along the line 3—3 of FIG. 2 in the direction of the appended arrows;

FIG. 4 is an edge elevation view, shown partly in cross-section, of the assembled spindle/cylindrical lock body/mortise cylinder/pull plate combination of FIG. 1 as installed in a door;

FIG. 6 is an elevation view of the outwardly-directed face of the cylindrical lock body shown in FIGS. 1 and 5;

FIG. 9 is a top plan view of the chassis plate device of FIG. 8;

FIG. 10*a* is a view of the chassis plate shown in FIG. 8 in combination with the cylindrical lock spindle in its normal non-rotated position, viewed along the line 10—10 of FIG. 4 in the direction of the appended arrows;

FIG. 10*b* is the combination shown in FIG. 10*a* but with the cylindrical lock spindle rotated for retractively engaging the latchbolt retractor mechanism;

FIG. 11 is an inwardly directed elevation perspective view of a preferred embodiment of a lock cylinder or mortise cylinder for combination with the cylindrical lock in accordance with a preferred embodiment of the present invention;

DESCRIPTION OF THE PREFERRED EMBODIMENTS

Figure 1:
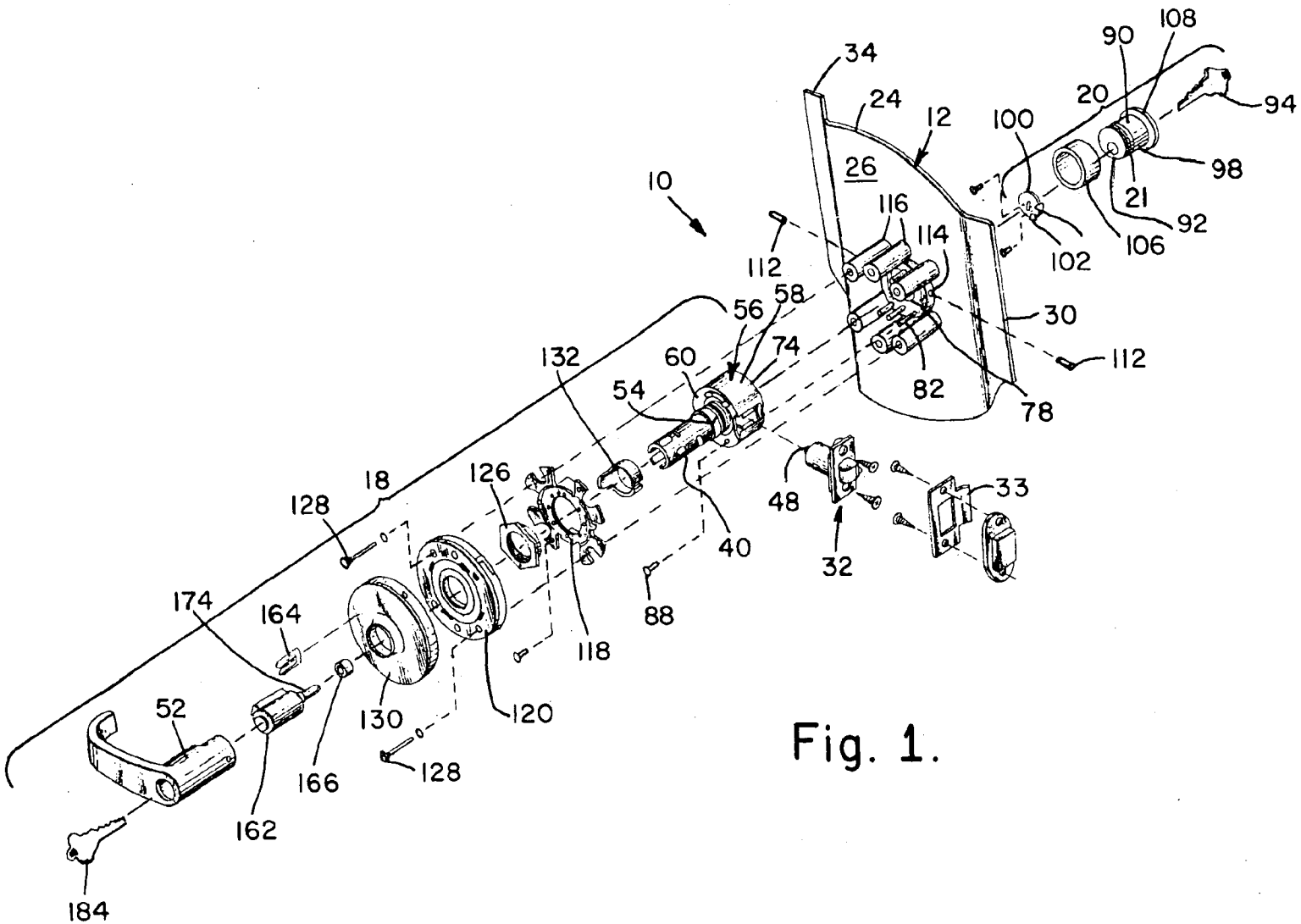
FIG. 1 is an exploded perspective view of a preferred embodiment of a door lock apparatus according to the present invention, viewed generally from inside a room or building door to which the device may be attached.

Turning first to FIGS. 1–5, a preferred embodiment of the door lock apparatus 10 according to the present invention includes a door trim, preferably a plate such as a pull plate 12, secured to the outside face 14 of a door 16; a cylindrical lock assembly 18 secured to and inwardly extending from the pull plate 12; and a cylinder lock assembly 20, key-accessible from the outside, secured to the pull plate 12. The cylinder lock assembly 20 includes a cylinder lock 21, preferably a mortise lock cylinder, and the mortise cylinder assembly 20 communicates with the cylindrical lock assembly 18 through an aperture or opening 22 through the pull plate 12. As will be appreciated, the invention may be implemented by alternative embodiments that do not include a trim or plate secured to the outside face of the door; other embodiments may include a trim or plate (which need not be flat) without a pull, and a separate pull handle may be secured to the outside face of the door.

Figure 5:
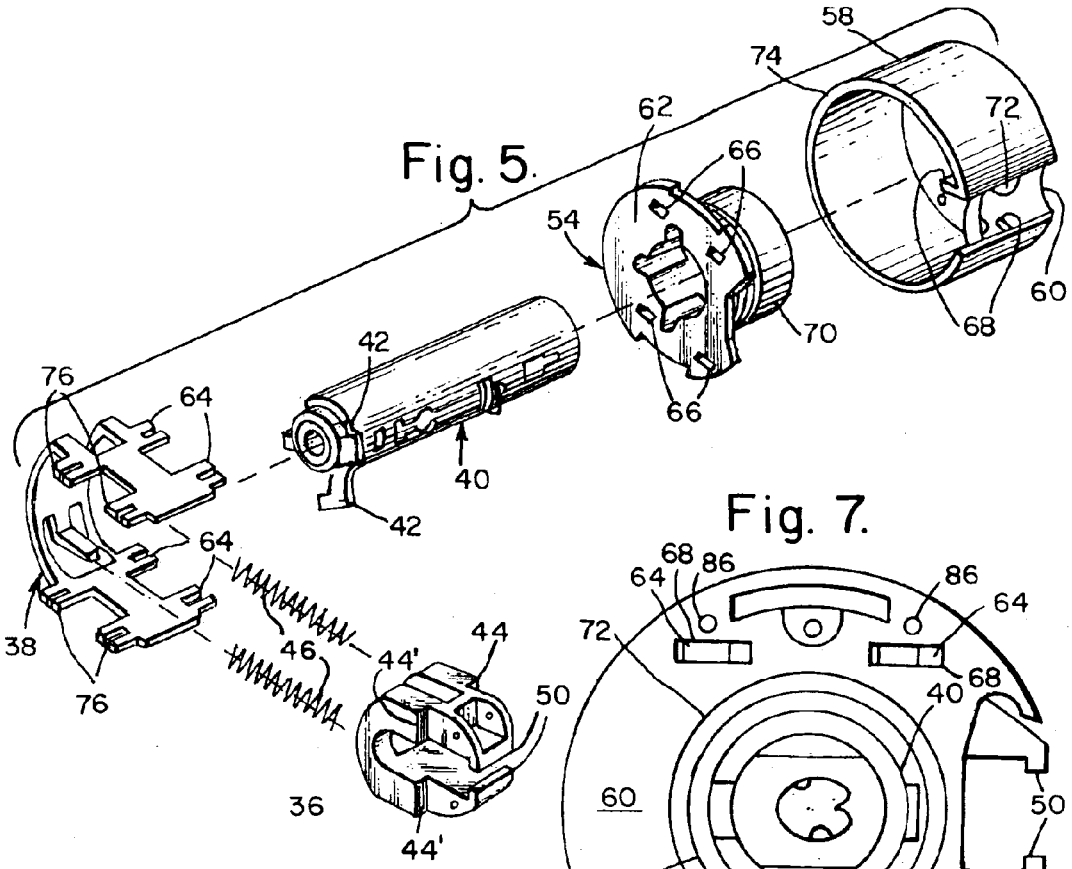
FIG. 5 is an exploded view of a disassembled cylindrical lock body and spindle of FIG. 1, shown axially opposite the arrangement shown in FIG. 1 to facilitate description thereof.

The words "outside" or "outer", when used herein in connection with the door 16 or the pull plate 12, refer to the direction or disposition outside the room or building to which the door 16 permits persons to gain entry, and the words "inside" or "inner" refer to the direction or disposition within the room or building served by the door 16. For example, the outside or outer face 24 of the pull plate 12 faces outwardly of the room, shown in FIGS. 1 and 4 as facing a direction to the right of the pull plate 12; and the inside or inner face 26 of the pull plate 12 is facing inside the room (when the door 16 is closed), shown in FIGS. 1 and 4 as facing a direction to the left of the pull plate 12. The outside direction in FIG. 5 is to the left in the drawing.

The pull plate 12 is preferably of a type having a midsection 28 for engaging the door 16, an edge 30 preferably astragal extending along the door edge containing the cylindrical lock latchbolt 32 and outwardly of the gap between the door edge and door frame where the latchbolt 32 engages the strike 33 secured to the edge of the frame, and an outwardly extending pull handle 34 along the opposite edge of the pull plate 12. Examples of such pull plates are shown in U.S. Patent Des. 354,670, as well as in U.S. patent applications Ser. Nos. 29/142,165 and 29/142,129, each of which patent and patent applications are incorporated herein by reference. The curved or sloped top and/or bottom edges of the pull plate 12 along the outward extension arm 29 between the midsection 28 and the handle 34, tapering toward the handle 34, in combination with the cylindrical lock apparatus of the present invention increases the anti-vandal advantage of the assembly; e.g., a rope or chain looped about the handle 34 will tend to slip off the pull plate 12 when the rope or chain is pulled.

Except as noted later, the cylindrical lock assembly 18 may be of a type well known in the art, as exemplified by U.S. Pat. No. 4,869,083 of DeMarseilles et al. and U.S. Pat. No. 4,428,212 of Best et al., the disclosures of which patents are incorporated herein by reference. In particular, except as modified by the present invention as described herein, the various components of the cylindrical lock assembly 18 shown in FIG. 1 are included in commercially available cylindrical lock sets, such as cylindrical lock sets marketed by Sargent Manufacturing Corporation (of New Haven, Conn.) under the designation "10-Line and FW-10 Line Locks.", Such prior art cylindrical locks typically include a cylindrical lock chassis or body containing a latchbolt retractor unit including a retractor 36 spring-biased against a chassis frame 38 (see FIG. 5). A conventional cylindrical lock includes an outside chassis plate device and an inside chassis plate device secured to either side of the retractor frame 38, with a pair of spindles (each generally similar to the spindle 40 shown in FIG. 5) rotationally supported by the respective chassis plate devices. The conventional cylindrical lock body is mounted within a large bored hole (typically 2½ inch diameter) through the faces of the door, and a smaller diameter bore (typically 1 inch diameter) extending from the edge of the door intersects the larger bore and contains the latchbolt unit 32 secured to the door's edge. The two spindles extend from opposite sides of the conventional cylindrical lock body, one spindle extending inwardly and the other extending outwardly, and each spindle may be rotated by means of attached respective handles. Upon such rotation of one of the spindles, one ear 42 of a pair of ears 42 laterally extending from the spindle engages an appropriate one of the retractor's bearing surfaces 44 or 44' (one of the two surfaces 44 being hidden in FIG. 5), urging the retractor 36 rearwardly edgewise (i.e. to the left as shown in the drawing of FIG. 5) against the bias of the springs 46. Since the latchbolt tail piece 48 (FIG. 1) is captured between the jaws 50 (FIG. 5) of the retainer 36, rotation of either of the two spindles 40 causes the latchbolt 32 to be retracted into the door (i.e., unlatching the door); release of the handle permits the springs 46 to return the retractor 36 to its unretracted position, causing the latchbolt 32 to return to its extended or latching position.

The present invention utilizes one spindle 40 and handle 52, and one chassis plate device 54, which are located inside as shown in FIGS. 1 and 4. The cylindrical lock body 56 includes a housing 58 having an inwardly facing cover portion 60 but without an outwardly facing cover portion, i.e. the outwardly directed face of the lock body 56 exposes the outwardly facing side of the assembled retractor 36 and chassis frame 38 within the housing 58, such as shown in FIG. 6. The chassis frame 38 is secured within the housing 58, while securing the chassis plate device 54 with its plate portion 62 secured between the inwardly facing side of the retractor 36 and the housing's inwardly facing cover portion 60, by means of inwardly extending chassis frame prongs 64 projecting through correspondingly positioned chassis plate slots 66 (see also FIG. 8) and thence correspondingly positioned slots 68 in the housing's inwardly facing cover portion 60 (see also FIG. 7). An externally threaded tubular portion 70 of the chassis plate device 54 inwardly extends through a central aperture 72 in the housing's cover portion 60. The spindle 40 longitudinally extends within and is rotationally supported by the chassis plate tubular portion 70, with the spindle's ears 42 positioned between the outwardly directed face of the chassis plate 62 and the retractor 36 forwardly edgewise of the bearing surfaces 44 so as to permit operative engagement therewith as is well known in the art.

Figure 7:
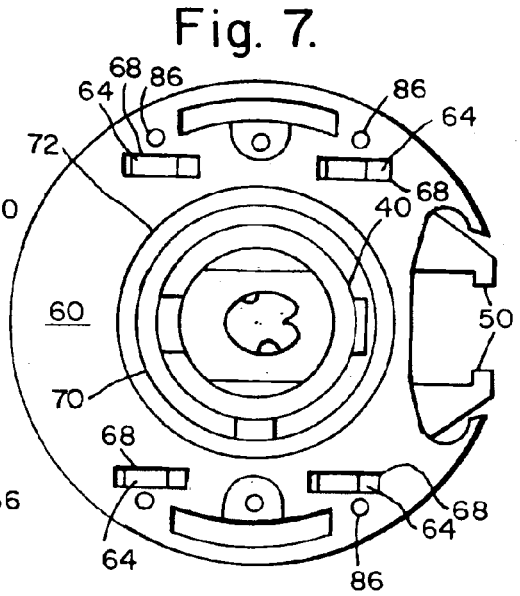
FIG. 7 is a rear elevation view of the spindle/cylindrical lock body combination of FIG. 1, as viewed along the line 7—7 of FIG. 4 in the direction of the appended arrows.
Figure 8:
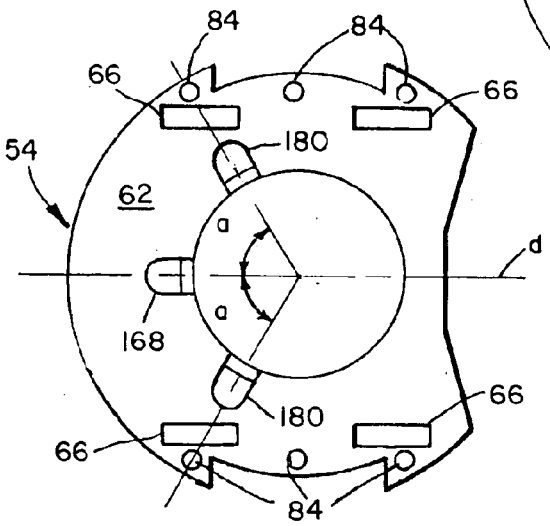
FIG. 8 is an elevation view of the face of a preferred embodiment of a chassis plate device within the cylindrical lock body of FIG. 6.

According to the preferred embodiment of the present invention, the lock body 56 and spindle 40 assembly is secured to the pull plate 12 with the outwardly facing side of the retractor 36 operatively accessible through the pull plate aperture or opening 22. The outside diameter of the lock body housing may be approximately 2 inches, the height of the retractor 36 may be 1 3/16 inches, the length of the retractor 36 may be approximately 1⅛ inches, and the pull plate opening 22 may be approximately 1⅛ inches. The center of the pull plate opening 22 is preferably aligned slightly above the center of the substantially circular lock body housing 58, for reasons that will be apparent later in this description. In one manner of securing the cylindrical lock body 56 to the pull plate 12, the lock body 56 is positioned with the outwardly-directed circumferential edge 74 of the lock body housing 58 adjacent to or contacting the pull plate inner surface 26 (the outwardly directed prongs 76 of the chassis frame 38 having been shortened to permit such positioning), or preferably adjacent to or contacting an attachment plate 78 (see also FIG. 12) secured to the pull plate inner surface 26 (such as by soldering) and having an aperture or opening 80 therethrough aligned with the pull plate opening 22 as later described. A plurality of inwardly directed internally threaded posts 82 are secured (such as by soldering) to the attachment plate 78, or directly to the pull plate 12 in the absence of an attachment plate 78. In the preferred embodiment, the posts 82 longitudinally extend into the lock body 56 and are of a length such that their inner ends are adjacent to or contact the chassis plate 62 at or about respective apertures 84 which in turn are aligned with respective apertures 86 in the housing cover portion 60 through which cap screws 88 are inserted for threadably engaging the posts 82 (FIGS. 1, 7 and 8).

The preferred embodiment of the present invention utilizes a lock cylinder of a type conventionally used in mortise locksets, in combination with the cylindrical lock assembly 18, for unlatching the cylindrical lock latchbolt 32 by outside key operation. Mortise locks and the function and operation of mortise lock cylinders are discussed in U.S. Pat. No. 5,992,195 of Huang et al. and in U.S. Pat. No. 6,178,794 to Eller et al., the disclosures of each of which patents are incorporated herein by reference.

Turning to FIGS. 1, 4 and 11, the mortise lock cylinder assembly 20 according to the present invention includes a mortise lock cylinder 21 including a generally cylindrical housing 90 and an internal cylinder 92 which is rotatable within the housing 90 by insertion and rotation of a key 94. Such mortise cylinders are commonly available, for example the "40 Series" mortise cylinders marketed by Sargent Manufacturing Corporation, and the cylindrical housing 90 may include threads 96 adjacent its rear end and longitudinal notches or grooves 98, 98' (FIGS. 1,11, 12 and 16) horizontally spaced apart (at the 3 o'clock and 9 o'clock positions) when the mortise cylinder 21 is secured to the pull plate 12 which in turn is secured to the door 16. The rear end of the key-rotatable cylinder 92 (i.e., its inwardly facing end when the cylinder housing 90 is secured to the pull plate 12) has secured thereto a cam which is rotatable with the key-operated cylinder 92, for operating the retractor 36 by engaging and disengaging the retractor's bearing surfaces 44' (FIGS. 5 and 6). As shown in FIG. 1, the cam 100 may include a pair of lateral projections or ears 102 similar to the ears 42 of the spindle 40 and which operate upon the retractor bearing surfaces 44' upon key-rotation of the cylinder 92 in similar manner as do the ears 42 operating upon the retractor bearing surfaces 44 upon rotation of the spindle 40. Another preferred embodiment of the cam is shown in FIG. 11, represented by reference numeral 104, and has further advantages as described below. The assembly 20 preferably includes a cylindrical collar 106 about the forward portion of the cylinder 90 and longitudinally captured between the pull plate 12 and a forward rim 108 of the cylinder 90.

Figure 13:
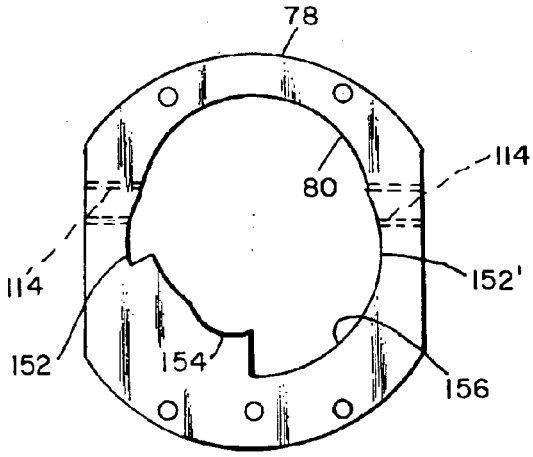
FIG. 13 is a rear view of a preferred embodiment of the attachment plate of FIG. 12.
Figure 14:
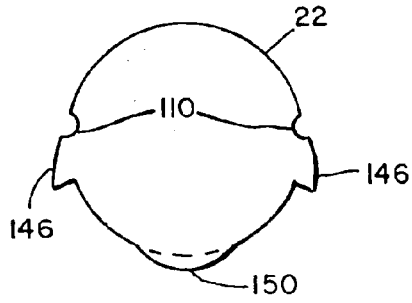
FIG. 14 is a representation of a preferred configuration of the opening through the pull plate as shown in less detail in FIG. 2.

The mortise cylinder 21 is secured to the pull plate 12 by inserting the rear end of the cylinder 21 through the pull plate opening 22 with the cam 102 or 104 in operative engagement with the cylindrical lock retractor 36 inwardly of the pull plate 12. Although a threaded nut may be threaded upon the cylinder's threads 96 and inwardly engage the pull plate inner surface 26, it is preferred that securement be implemented by means of the attachment plate 78. The mortise cylinder 21 is positioned in the pull plate opening 22 such that the internal key cylinder 92 is at the 6 o'clock position; when using a mortise cylinder 21 having the longitudinal grooves 98, 98', the opening 22 may include centrally oriented circumferential protrusions 110 (FIG. 14) at the 3 o'clock and 9 o'clock positions, respectively, for engaging the cylinder's grooves 98' and 98. The cylinder 90 extends through the pull plate opening 22 and the attachment plate opening 80 such that the cam 104 (or 100) is positioned for engaging the retractor bearing surfaces 44'. The cylinder 90 is releasably secured in this position by set screws 112, threadedly engaged in threaded lateral bores 114 through the attachment plate 78, engaging the mortise cylinder 90 at the respective grooves 98, 98' (FIGS. 1 and 13). In one example, the mortise cylinder 90 was approximately 1 5/32 inches in diameter and 1 1/8 inches long, the thicknesses of the pull plate 12 and attachment plate 78 were approximately 3/32 and 13/32 inch respectively, and the collar 106 was approximately 21/32 inch long with a 1/8 inch internal circumferential recess for receiving the cylinder's 1/8 inch cap shoulder.

The pull plate 12 with the secured lock body 56/spindle 40 assembly and the secured mortise lock cylinder assembly 20, is secured to the outer face 14 of the door 16. In one manner of effecting such securement, the pull plate's rear or inner surface 26 has secured thereto (as by soldering) a plurality of inwardly extending internally threaded posts 116 (such as the six posts 116 shown in FIGS. 1 and 12, typically of copper) spaced about the aperture 22 for registration with the plurality of openings in support plate 118 and the plurality of spaced apertures in rose 120. Alternatively, the soldered copper posts 116 may be replaced by conventional internally threaded sex bolts extending through apertures in the plate 12.

The cylindrical lock body 56 is positioned within the large bored hole 122 (typically 2½ inches in diameter) through the faces of the door 16, intersecting a smaller diameter bore containing the latchbolt unit 32 at the door's edge (such bores being conventional as previously described), and the posts 116 (which are slightly shorter than the width of the door 16) extend within respective bores 124 parallel to and spaced about the large bore 122. An internally threaded spacer hex nut 126 threadedly engages the threads on the tubular portion 70 of the chassis plate device 54 while securing the support plate 118 against the door's inner face. Securement is completed by installing the rose 120 with the screws 128 extending through the apertures in the rose 120 and threadedly engaging the respective internally threaded posts 116, and positioning the rose scalp 130 in place. The handle 52 is then installed onto the spindle 40 with spacer bushing 132 in place. The installation of cylindrical door locks employing a handle 52, a support plate 118, a spacer nut 126, a rose 120, a rose scalp 130, and a spacer bushing 132 is well known; see, for example, the disclosure of U.S. Pat. 4,869,083, incorporated herein by reference.

When installed on a door, the present invention provides a cylindrical lock having increased security against unauthorized entry and vandalism, while permitting free egress and authorized entry. The door may be latched and unlatched from inside by rotating the handle, while the door may be unlatched from outside only with a key in which case entry may be gained by pulling the pull handle 34 of the pull plate 12. Since only the face of the mortise cylinder 21 and its collar 106 are exposed on the outer face of the door, it is extremely difficult for a prospective vandal to grab or remove the mortise lock 21 and to damage the cylindrical lock assembly 18. In a preferred embodiment of the pull plate 12, its overlapping astragal edge 30 prevents destructive access to the cylindrical lock's latchbolt 32 while its curved top and bottom edges tapering toward the pull handle 34 prevent forced entry by a looped rope or chain as previously discussed.

The mortise cylinder assembly 20 may be removed from the pull plate 12 (to permit re-keying thereof), by removing certain of the components of the cylindrical lock assembly 18 situated inside the door. A feature of the preferred embodiment precludes removal of the mortise cylinder assembly 20 without the mortise cylinder key 94 operating the rotatable cylinder 92 of the mortise cylinder 21, as described below.

Turning to FIG. 11, the preferred mortise cylinder cam 104 includes a disk 134 (of about 0.75 inch diameter and 0.115 inch thickness in one example) attached to the rear face of the key-rotatable cylinder 92 and concentric therewith such that the disk 134 rotates with key-rotation of the cylinder 92. An arcuate member 136 (of approximately 0.625 inch outside radius extended through an arc of approximately 162° in this example), attached along the periphery of the disk 134, projects rearwardly (i.e. inwardly) from the front (i.e. outwardly facing) surface of the disk (by about 0.260 inch in this example); the arcuate member 136 may be attached to the disk 134 as by soldering, or the disk 134/arcuate member 136 may be cast or machined in one piece. The arcuate member 136 terminates at cam ends 138. The disk 134 is attached to the rotatable cylinder 92 such that the convex peripheral wall 140 of the arcuate member 136 faces the cylindrical lock latchbolt 32 and the cam ends 138 are horizontally equidistant from a vertical centerline 142 when the key 94 is not inserted in the rotatable cylinder 92 (i.e. when the cylinder 92 is in its normally "locked" condition); see FIG. 12. The peripheral wall 140 of the arcuate member 136 contains two longitudinal notches 144 symmetrically spaced apart along the peripheral wall 140 by approximately 90° (the notches 144 spaced approximately 45° from a horizontal centerline 143 when in the "locked" condition). The position of the center of the rotatable cylinder 92 on the rear face of the mortise cylinder 21 and the diameter of the disk 134 results in the circumference of the disk 134 extending slightly below the circumference of the mortise cylinder housing 90 (by approximately 1/8 inch in this example).

Figure 12:
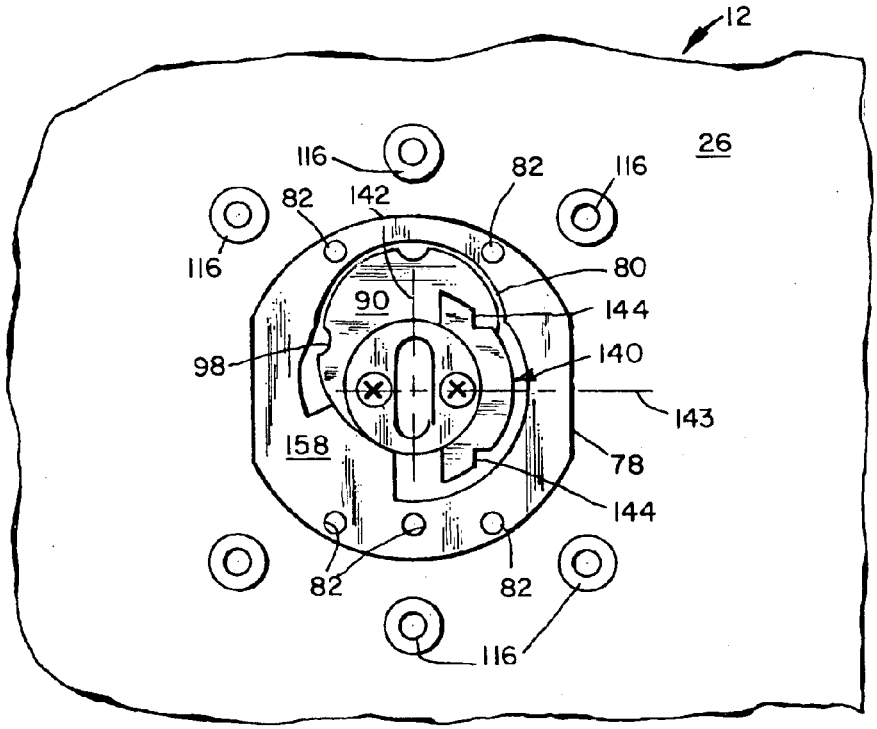
FIG. 12 is a rear elevation view of a fragment of the pull plate shown in FIG. 1, with attachment plate securing the mortise cylinder of FIG. 11 thereto, as viewed along the line 12—12 of FIG. 4 in the direction of the appended arrows.
Figure 15:
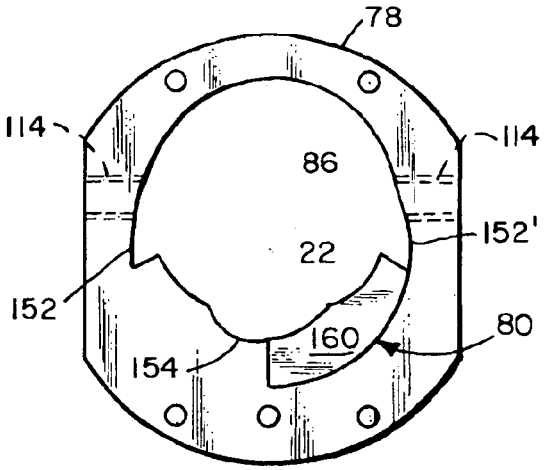
FIG. 15 is an inwardly directed elevation view of the attachment plate of FIG. 13 secured to the inside face of the pull plate of FIG. 2 in registration with the pull plate opening of FIG. 14.
Figure 16:
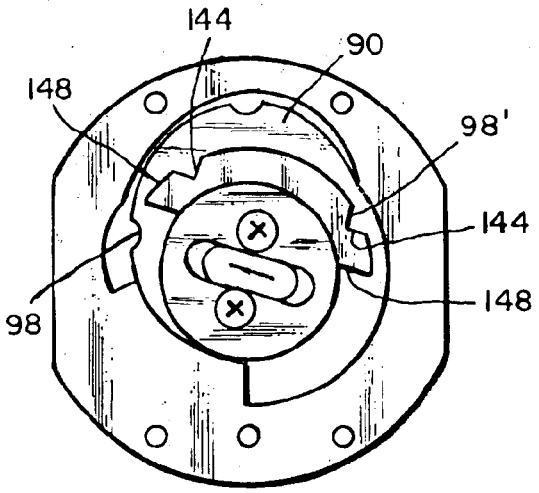
FIG. 16 is a view of the attachment plate/pull plate opening/mortise cylinder combination similar to FIG. 12 but shown with the mortise cylinder cam in rotational position for being installed in or removed from the cylindrical lock body according the preferred embodiment of the present invention.

FIG. 12 shows the mortise cylinder assembly 20 installed on the pull plate 12, through the pull plate opening 22 (FIGS. 2 and 14) and the opening 80 through the attachment plate 78 (see also FIGS. 13 and 15). Although not shown in FIG. 12 for purposes of clarity of description, the mortise cylinder housing 90 is rotationally oriented and constrained against rotation from such orientation by the pull plate horizontally disposed lateral projections 110 (FIG. 14) inserted along the mortise cylinder's longitudinal grooves 98 and 98' (groove 98' is shown in FIG. 16), and the mortise cylinder housing 90 is rotationally and longitudinally secured to the attachment plate 78 by the set screws 112 engaging cylinder 90 at the grooves 98, 98' as previously described. The mortise cylinder 90 is therefore rotationally fixed with the arcuate cam member 136 rotationally positioned with the rotatable cylinder 92 in its key-removed locked condition as shown in FIG. 12. When the key 94 is inserted in the mortise cylinder 90 and the rotatable cylinder 92 is rotated in either direction, one of the pair of cam ends 138 coercively engages a corresponding one of the pair of retractor bearing surfaces 44' (FIG. 6), urging the retractor 36 laterally rearwardly (i.e. to the left as shown in the drawing of FIG. 12) against the bias of the springs 46, thereby causing the latchbolt 32 to be retracted into the door 16 to the latchbolt's unlatched position. When the key is released, the springs 46 return the retractor 36 to its unretracted position, causing the cam 104 and hence the rotatable cylinder 92 to return to their normal condition as shown in FIG. 12 whereupon the key 94 may be removed with the latchbolt 32 in its extended or latched position.

When installing the mortise cylinder 21 on the pull plate 12, the rotatable cylinder 92 is key-rotated until one of the notches 144 on the arcuate cam member 136 is rotationally aligned with one of the longitudinal grooves 98 or 98' along the mortise cylinder housing 90 and with the portion of the arcuate member 136 between the notches 144 positioned within the upper semicircle of the mortise cylinder housing 90. Alignment of a notch 144 with the groove 98' is shown in the example of FIG. 16. The pull plate opening 22 is configured with cutouts 146 immediately below the projections 110, each cutout generally conforming to (and slightly larger than) the profile of the end portions 148 of the arcuate cam member 136 between the notch 144 and a cam surface 138. Although the general circular outline of the pull plate opening 22 is of diameter slightly greater than the diameter of the mortise cylinder housing 90, the opening 22 in this preferred embodiment includes at its 6 o'clock position an arcuate extension generally conforming to the portion of the circumference of the disk 134 extending below the circumference of the mortise cylinder housing 90; in FIG. 14, the dashed curve above the arcuate extension 150 represents a phantom continuation of the otherwise generally circular configuration of the opening 22. The attachment plate 78 (FIG. 13), includes cutout portions 152, 152' generally conforming to the cutout portions 146 of the pull plate opening 22, as well as an arcuate extension 154 (generally conforming to the arcuate extension 150 of the pull plate opening 22) depending from the circular portion of the attachment plate opening 80 having a diameter slightly greater than the diameter of the mortise cylinder housing 90. The attachment plate opening 80 further includes an arcuate cutout 156 from the opening's 3 o'clock to 6 o'clock positions, for facilitating entry of the cam arcuate member 136 into engageable position with the retractor 36. FIG. 15 shows the configuration of the opening resulting when the attachment plate 78 is secured to the pull plate 12 with the pull plate opening 22 and the attachment plate opening 80 in registration. The cam 104 is preferably positioned in its entirety rearwardly (i.e. inwardly) of the rear (inwardly facing) surface 158 of the attachment plate 78, and the recess 160 provided by the attachment plate arcuate cutout 156 rearwardly (inwardly) of the pull plate 12 facilitates installation of the cam arcuate member 136 into engageable position with the retractor 36, as well as facilitating removal of the mortise cylinder assembly 20 from the pull plate 12 and cylindrical lock assembly 18 when desired.

A feature of the invention is the ease of removal of the mortise cylinder assembly 20 from the pull plate 12 and cylinder lock assembly 18, such as for re-keying. Referring to FIGS. 1 and 4, the door lock apparatus 10 is dismounted from the door 16 by removing the handle 52, the rose scalp 130, the rose 120, the hex spacer nut 126, and the support plate 118, all from the inside of the door 16. The pull plate 12 with attached cylindrical lock body housing 58/spindle 40 assembly and attached mortise lock cylinder assembly 20 may then be outwardly removed from the door 16. With the key 94 in the rotatable cylinder 92 of the mortise cylinder 21, the two set screws 112 are loosened and the key 94 is then turned to rotate the cam 104 as needed to make its way through the attachment plate opening 80 and the pull plate opening 22 and their combined labyrinth of cutouts, while outwardly withdrawing the mortise cylinder 21 with its longitudinal grooves 98, 98' in registration with the pull plate opening protrusions 110. The provision that the key 94 be in the mortise cylinder 21 for effecting removal of the mortise cylinder assembly 20 from the pull plate 12 is for increased assurance that re-keying is performed by an authorized person. Re-keying may be alternatively or further facilitated by utilizing a removable or interchangeable core cylinder (for example, Schlage Model No. 30-008).

A hold-back capability may be provided as a feature of the preferred embodiment of the present invention. The handle 52 (FIG. 1) may be equipped with a locking device, such as a conventional key-operable bored lock cylinder 162 (with a conventional cylinder retainer 164 and cylinder spacer 166) operable in combination with mechanisms in the spindle 40 and the cylindrical lock body 56, for holding the handle 52 in a rotated position to maintain the latchbolt 32 in its retracted position. In this manner, the door 16 is converted to one that remains unlatched and may be opened by a push from the inside or a pull from the outside. Unlocking the locking device from the inside returns the cylinder lock assembly 18 to normal operation where the normally latched door may be unlatched when the handle 52 is rotated.

Figure 17A:
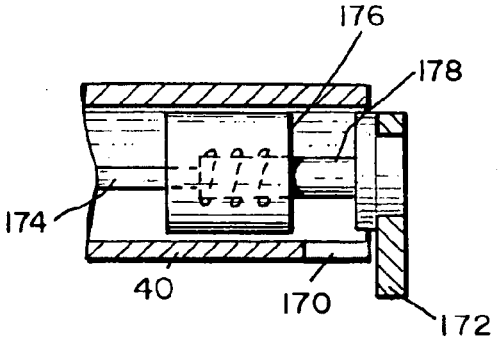
FIGS. 17*a* and 17*b* represent longitudinal partly cross-sectional views of the outwardly-directed end of a cylindrical lock spindle showing one type of mechanism for translating a spindle tab device during implementation of a hold-back feature in accordance with the preferred embodiment of the present invention.

In a conventional cylindrical lock assembly, such as described in U.S. Pat. Nos. 4,869,083 and 4,428,212, the lock body 56 includes both an inner chassis plate device and an outer chassis plate device respectively coupled to an inside spindle and an outside spindle operatively attached to respective inside and outside handles. A conventional outside handle may include a locking device for operating a mechanism in the outside spindle that cooperates with the outer chassis plate device for preventing rotation of the outside spindle while the door is latched in order to prevent the door from being opened from the outside without a key, such as embodied in the commercially available locksets marketed by Sargent Manufacturing Corporation under the designation "10-Line NFW-Line Locks." The outside handle of such locksets is provided with a bored lock cylinder similar to the bored lock cylinder 162 shown in FIG. 1. The outside chassis plate device is provided with a radial notch horizontally positioned along the direction of retractor retraction and extending from the chassis plate of the outside chassis plate device through its tube portion, for example the notch 168 shown in FIG. 8 and in phantom in FIG. 9. The outside spindle 40 is also provided with a longitudinal notch 170 (see FIG. 17*a*) diametrically opposite the spindle's ears. When the spindle 40 is in its normal latching position, the spindle notch 170 is radially aligned with the notch 168 in the stationary chassis plate. A radially extending member or tab 172 (shown in FIGS. 10 and 17), is supported within the spindle 40 such that the spindle is rotatable with respect to the tab 172 and the tab 172 is longitudinally translatable with respect to the spindle 40. The tab 172 is rotationally trapped within the chassis plate notch 168. When the spindle 40 is rotationally in its normal latching position, the spindle notch 170 is radially aligned with the chassis plate notch 168. When the bored lock cylinder 162 in the outside handle is in its unlocked condition, the tab 172 is longitudinally beyond the spindle notch 170, so that the spindle is free to rotate with rotation of the outside handle. Rotation of an inserted key in the bored lock cylinder 162 causes lock stud or tail piece 174 to similarly rotate, in turn causing tab 172 to longitudinally travel into the spindle notch 170, preventing the spindle 40 and its attached handle from being rotated, thereby causing the door to be locked from the outside. Rotational-to-translational motion converter devices are well known, including the device shown in FIG. 17 where rotation of internally threaded bushing 176 by the bored lock cylinder stud 174 causes translation of screw support 178 upon which the tab 172 is radially mounted.

Figure 17B:
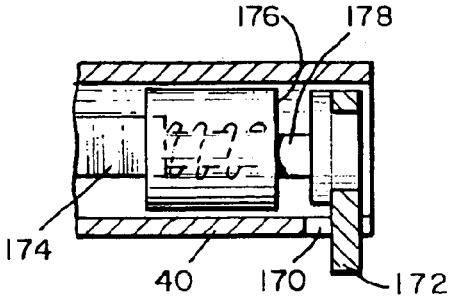

The hold-back feature of the present invention, in a preferred embodiment, is implemented by employing on the inside of the door 16 the handle with contained bored lock cylinder 162, the spindle 40 configured with the rotational-to-translational motion converter and tab 172 as in FIG. 17—each of which is conventionally employed on the outside of the door—in combination with the chassis plate device 54 according to the present invention.

As shown in FIGS. 5, 8 and 9, the chassis plate device 54 includes at least one and preferably two radially disposed notches 180 similar to the notch 168 but angularly displaced therefrom (i.e. angularly displaced from the horizontal diameter d of the chassis plate 62 when installed) by an angle a equal to the angle of rotation of the spindle for unlatching the latchbolt 32, for example by 55°. The provision of two notches 180 is for accommodating both right and left handed doors.

The tab 172 is positioned within and captured by one of the chassis plate notches 180, as shown in FIG. 10. FIG. 10*a* shows the spindle 40 in its normal position when the door is latched, with the spindle notch 170 rotationally positioned along the horizontal diameter d of the chassis plate 62 (i.e. in radial alignment with the prior art chassis plate notch 168). In FIG. 10*a*, the rotational position of the handle 52 is horizontal, as represented by the line 182. When the handle 52 is rotated to the door unlatching position, represented in FIG. 10*b* by the rotated line 182, the spindle 40 is rotated such that the spindle notch 170 is positioned in radial alignment with the chassis plate notch 180 in which the tab 172 is captured. The hold-back feature of the present invention may be activated at this point, by inserting and turning the key 184 in the bore lock cylinder 162 of the handle 52, causing the tab 172 to longitudinally retract into the spindle notch 170 and, since the tab 172 remains captured in the stationary chassis plate notch 180, the spindle 40 is maintained or locked in this unlatched door position with the lever handle 52 angularly disposed along line 182 as shown in FIG. 10*b*. The fact of the lever handle 52 being locked in its rotated position is a visual indicator as to the hold-back feature being engaged, an indication which is of importance in public applications and of particular importance in school applications. In this position, the door may be opened by a push from the inside or a pull from the outside.

When it is desired to release the hold-back and return the door to normal operation in accordance with the present invention, the key 184 is inserted in the bored lock cylinder 162 of the handle 52 and rotated in the opposite direction until the tab 172 longitudinally travels beyond the spindle notch 170, releasing the spindle and permitting its rotation for permitting normal latching and unlatching of the door.

The provision of a bored lock cylinder 162 in the handle 52 further assures that re-keying of the mortise cylinder 21 is performed by authorized personnel, since removal of the handle 52 (by conventional push-pin depression of a lever catch in the spindle) from its spindle 40 requires that the key 184 be inserted and rotated in the lock 162. This feature, which is conventional for outside handles, provides added security when applied to the inside handle 52.

Thus there have been described preferred embodiments of a door lock apparatus in which a cylinder lock such as mortise lock cylinder is employed for unlatching a cylindrical lock assembly. The mortise lock cylinder is preferably secured to the outside of the door trim such as a pull plate, with the cylindrical lock mounted to the inside of the pull plate, and the pull plate is mounted to the door, in such manner as to effect an anti-vandal door lock assembly. Preferred embodiments include a hold-back feature, as well as a feature for facilitating secured removal of the mortise lock cylinder as for re-keying, although other preferred embodiments need not include such features. Handles other than the preferred lever handle for the cylindrical lock assembly, including knob handles, may be utilized. Although the two lock cylinders 92 and 162 are preferably key-actuated, other types of actuator devices may be employed, for example electronic, magnetic, optical or computer coded devices. It may be appreciated that other embodiments of the present invention, and variations of the embodiments described herein, may be developed without departing from the essential characteristics thereof. Accordingly, the invention should be limited only by the scope of the claims listed below.

We claim:

1. A door lock apparatus, comprising the combination of:

a trim plate securable to the outside of a door;

a cylindrical lock assembly secured to said trim plate inwardly thereof when said plate is secured to the door, said cylindrical lock assembly including a latchbolt, a lock body having a retractor for said latchbolt, a spindle inwardly extending from said lock body and coupled to said retractor for unlatching said latchbolt upon rotation of said spindle, and a handle secured to said spindle for rotating said spindle;

a cylinder lock including a housing and a cylinder actuable for rotation in said housing, said cylinder lock secured to said trim plate and outwardly extending from said lock body;

a cam secured to said cylinder and rotatable therewith, said cam coupled to said retractor for unlatching said latchbolt upon rotation of said cylinder;

a key insertable in said cylinder lock and rotatable for rotating said cylinder;

said trim plate includes an opening with at least two spaced radial protrusions into said opening;

said cylinder lock is a mortise lock cylinder including at least two longitudinal grooves therealong in registration with said at least two protrusions for rotationally orienting said mortise lock cylinder on said trim plate; and said rotatable cam includes an arcuate member having cam ends for operatively cooperating with said retractor upon rotation of said cam by said key inserted in said mortise lock cylinder, said arcuate member including peripheral notches at least one of which is alignable with a one of said grooves and a one of said protrusions when said cam is rotated by said key inserted in said mortise lock cylinder.

2. The apparatus according to claim 1, wherein:

said opening in said trim plate further includes a cutout adjacent at least one of said protrusions configured for permitting a one of said cam ends to pass through said cutout when said cam is rotated by said key inserted in said mortise lock cylinder.

3. The apparatus according to claim 2, further including:

an attachment plate secured to said trim plate, said attachment plate including an opening configured with at least one cutout similar to said at least one cutout in said trim plate, said openings including said cutouts in registration, said attachment plate adapted to releasably secure said mortise lock cylinder thereto when said mortise lock cylinder is inserted in said openings.

4. The apparatus according to claim 3, wherein:

said opening in said attachment plate further includes an arcuate cutout for facilitating entry of said arcuate member into engageable position with said retractor.

5. A door lock apparatus, comprising the combination of:

a trim plate securable to the outside of a door;

a cylindrical lock apparatus including a latchbolt, a lock body having a retractor for said latchbolt, a spindle inwardly extending from said lock body and coupled to said retractor for unlatching said latchbolt upon rotation of said spindle, and a handle securable to said spindle for rotating said spindle;

a cylinder lock including a housing and a cylinder actuable for rotation in said housing, and a cam secured to said cylinder and rotatable therewith;

said lock body with said spindle extending therefrom secured to said trim plate independently of the door and inwardly of said trim plate;

said housing of said cylinder lock secured to said trim plate independently of the door and outwardly extending from said lock body, and with said cam coupled to said retractor for unlatching said latchbolt upon rotation of said cylinder; and a hold-back apparatus in said cylindrical lock apparatus including a lock in said handle for locking said spindle when said spindle is in a rotated position unlatching said latchbolt.

6. The apparatus according to claim 5, wherein:

said handle is a lever handle and is in a rotated position when said spindle is locked with said latchbolt unlatched.

7. A door lock apparatus, comprising the combination of:

a trim plate securable to the outside of a door;

a cylindrical lock apparatus including a latchbolt, a lock body having a retractor for said latchbolt, a spindle inwardly extending from said lock body and coupled to said retractor for unlatching said latchbolt upon rotation of said spindle, and a handle securable to said spindle for rotating said spindle;

a cylinder lock including a housing and a cylinder actuable for rotation in said housing, and a cam secured to said cylinder and rotatable therewith;

said lock body with said spindle extending therefrom secured to said trim plate independently of the door and inwardly of said trim plate;

said housing of said cylinder lock secured to said trim plate independently of the door and outwardly extending from said lock body, and with said cam coupled to said retractor for unlatching said latchbolt upon rotation of said cylinder;

said lock body includes a chassis plate rotationally supporting said spindle and including a radial first notch;

said spindle includes a second notch in radial alignment with said first notch when said spindle is in a rotated position unlatching said latchbolt;

a radially extending member carried by said spindle and captured by said first notch; and a lock in said handle coupled to said member for moving said member longitudinally along said notches, when said notches are radially aligned, between a first longitudinal position captured by said second notch and a second longitudinal position not captured by said second notch.

8. The apparatus according to claim 7, wherein:

said handle is a lever handle and is in a rotated position when said latchbolt is unlatched.

9. The apparatus according to claim 7, wherein said lock in said handle includes a bored lock cylinder having a rotatable tail piece;

and further including a rotational-to-translational motion converter carried by said spindle for converting rotation of said tail piece to longitudinal movement of said member.

10. The apparatus according to claim 9, further including:

a key insertable in said bored lock cylinder and rotatable for rotating said tail piece.

11. A door lock apparatus, comprising the combination of:

a door trim securable to a face of a door;

a cylindrical lock apparatus including a latchbolt, a lock body having a retractor for said latchbolt, a spindle extending from a first side of said lock body and coupled to said retractor for unlatching said latchbolt upon rotation of said spindle, and a handle securable to said spindle for rotating said spindle;

a cylinder lock including a housing and a cylinder actuable for rotation in said housing, said cylinder lock extending from a second side of said lock body opposite said first side;

a cam secured to said cylinder, and rotatable therewith, said cam coupled to said retractor for unlatching said latchbolt upon rotation of said cylinder;

said cylinder lock secured to said door trim independently of the door with said cylinder rotatably actuable from one side of said door trim, and said lock body secured to said door trim independently of the door with said spindle rotatable from another side of said door trim opposite said one side; and a hold-back apparatus in said cylindrical lock apparatus including a lock in said handle for locking said spindle when said spindle is in a rotated position unlatching said latchbolt.

12. The apparatus according to claim 11, wherein:

said handle is a lever handle and is in a rotated position when said spindle is locked with said latchbolt unlatched.

13. A door lock apparatus, comprising the combination of:

a door trim securable to a face of a door;

a cylindrical lock apparatus including a latchbolt, a lock body having a retractor for said latchbolt, a spindle extending from a first side of said lock body and coupled to said retractor for unlatching said latchbolt upon rotation of said spindle, and a handle securable to said spindle for rotating said spindle;

a cylinder lock including a housing and a cylinder actuable for rotation in said housing, said cylinder lock extending from a second side of said lock body opposite said first side;

a cam secured to said cylinder and rotatable therewith, said cain coupled to said retractor for unlatching said latchbolt upon rotation of said cylinder;

said cylinder lock secured to said door trim independently of the door with said cylinder rotatably actuable from one side of said door trim, and said lock body secured to said door trim independently of the door with said spindle rotatable from another side of said door trim opposite said one side;

said lock body includes a chassis plate rotationally supporting said spindle and including a radial first notch;

said spindle includes a second notch in radial alignment with said first notch when said spindle is in a rotated position unlatching said latchbolt;

a radially extending member carried by said spindle and captured by said first notch; and a lock in said handle coupled to said member for moving said member longitudinally along said notches, when said notches are radially aligned, between a first longitudinal position captured by said second notch and a second longitudinal position not captured by said second notch.

14. The apparatus according to claim 13 wherein:

said handle is a lever handle and is in a rotated position when said latchbolt is unlatched.

15. The apparatus according to claim 13, wherein said lock in said handle includes a bored lock cylinder having a rotatable tail piece;

and further including a rotational-to-translational motion converter carried by said spindle for converting rotation of said tail piece to longitudinal movement of said member.

16. The apparatus according to claim 15, further including:

a key insertable in said bored lock cylinder and rotatable for rotating said tail piece.

17. A cylindrical lock apparatus for a door, comprising the combination of:

a latchbolt for latching the door, a lock body having a retractor for said latchbolt, a spindle extending from a first side of said lock body and coupled to said retractor for unlatching said latchbolt upon rotation of said spindle, a lever handle secured to said spindle for rotating said spindle to unlatch said latchbolt upon rotation of said lever handle to an angular disposition, and a lock in said handle for selectively locking said lever handle in said angular disposition, said angular disposition of said lever handle being a visual indicator that said latchbolt is locked in an unlatched position.

18. A cylindrical lock apparatus for a door, comprising the combination of:

a latchbolt, a lock body having a retractor for said latchbolt, a spindle coupled to said retractor for unlatching said latchbolt upon rotation of said spindle, and a handle secured to said spindle for rotating said spindle;

a chassis plate rotationally supporting said spindle with respect to said lock body, said chassis plate including a radial first notch;

a second notch in said spindle in radial alignment with said first notch when said spindle is in a rotated position unlatching said latchbolt;

a radially extending member carried by said spindle and captured by said first notch; and a lock in said handle coupled to said member for moving said member longitudinally along said notches, when said notches are radially aligned, between a first longitudinal position captured by said second notch and a second longitudinal position not captured by said second notch.

19. The apparatus according to claim 18, wherein said handle is a lever handle angularly disposed when said member is captured by said second notch, the angular disposition of said lever handle being a visual indicator that said latchbolt is unlatched.

20. The apparatus according to claim 19, wherein said lock in said lever handle includes a bored lock cylinder having a rotatable tail piece;

and further including a rotational-to-translational motion converter carried by said spindle for converting rotation of said tail piece to longitudinal movement of said member.

21. The apparatus according to claim 20, further including:

a key insertable in said bored lock cylinder and rotatable for rotating said tail piece.

22. The apparatus according to claim 5, wherein:

said lock in said handle is key actuable for locking and unlocking said spindle when said spindle is in said rotated position unlatching said latchbolt.

23. The apparatus according to claim 11, wherein said lock in said handle is key actuable for locking and unlocking said spindle when said spindle is in said rotated position unlatching said latchbolt.

24. The apparatus according to claim 17, wherein said lock in said handle is key actuable for locking said lever handle in said angular position when said latchbolt is unlatched.

* * * * *

UNITED STATES PATENT AND TRADEMARK OFFICE

CERTIFICATE OF CORRECTION

PATENT NO. : 6,868,704 B2
DATED : March 22, 2005
INVENTOR(S) : Ira J. Simon and Martin S. Simon It is certified that error appears in the above-identified patent and that said Letters Patent is hereby corrected as shown below:

Title page,
Item [56], References Cited, OTHER PUBLICATIONS,
add -- Catalog page 8, Architectural Builders Hardware Mfg., Inc., "Overhead Holders/ Stops, Electro-Magnetic Door Holders, Hospital Push/Pulls, Coordinators" (1998). --.

Column 15,
Line 8, "cain" should be -- cam --.

Signed and Sealed this

Twenty-fourth Day of May, 2005

JON W. DUDAS
*Director of the United States Patent and Trademark Office*